US007311456B1

(12) United States Patent
Neal

(10) Patent No.: US 7,311,456 B1
(45) Date of Patent: Dec. 25, 2007

(54) DISPOSABLE TOOTHBRUSH

(76) Inventor: Veal M. Neal, 17433 Virginia Ave., Apt. J, Bellflower, CA (US) 90706

( * ) Notice: Subject to any disclaimer, the term of this patent is extended or adjusted under 35 U.S.C. 154(b) by 0 days.

(21) Appl. No.: 11/448,935

(22) Filed: Jun. 8, 2006

(51) Int. Cl.

| | |
|---|---|
| ***A46B 11/00*** | (2006.01) |
| ***A46B 11/06*** | (2006.01) |
| ***A46B 11/04*** | (2006.01) |
| ***B43K 5/06*** | (2006.01) |

(52) U.S. Cl. ..... 401/47; 401/45; 401/46; 401/272; 401/291; 401/179

(58) Field of Classification Search ..... 401/44–47, 401/272, 291, 270, 176, 179
See application file for complete search history.

(56) References Cited

U.S. PATENT DOCUMENTS

| | | | | |
|---|---|---|---|---|
| 1,918,069 | A | 7/1933 | Wallace | |
| 3,738,762 | A | 6/1973 | Moore et al. | |
| 4,277,194 | A | 7/1981 | Smith | |
| 4,865,481 | A | 9/1989 | Scales | |
| 5,304,009 | A | 4/1994 | Marshall | |
| 5,425,590 | A | 6/1995 | Duty et al. | |
| 5,769,553 | A | 6/1998 | Chaudhri et al. | |
| 5,893,378 | A | 4/1999 | Llerena | |
| 6,142,694 | A | 11/2000 | Rivlin et al. | |
| 6,918,153 | B2 * | 7/2005 | Gruber | 15/22.1 |

* cited by examiner

*Primary Examiner*—David J. Walczak
(74) *Attorney, Agent, or Firm*—Mark A. Crossley; Crossley Patent Law

(57) ABSTRACT

A disposable toothbrush with triple compartment handle, for storing and dispensing three oral hygiene agents. The agents are dispensed via plungers with pistons within the compartments. The cap is sealed after agent inclusion during manufacturing with plungers sealed at passages through the cap. A taper, neck, conduit, and multiple openings within the head insure laminar delivery of agents to the brushes.

11 Claims, 2 Drawing Sheets

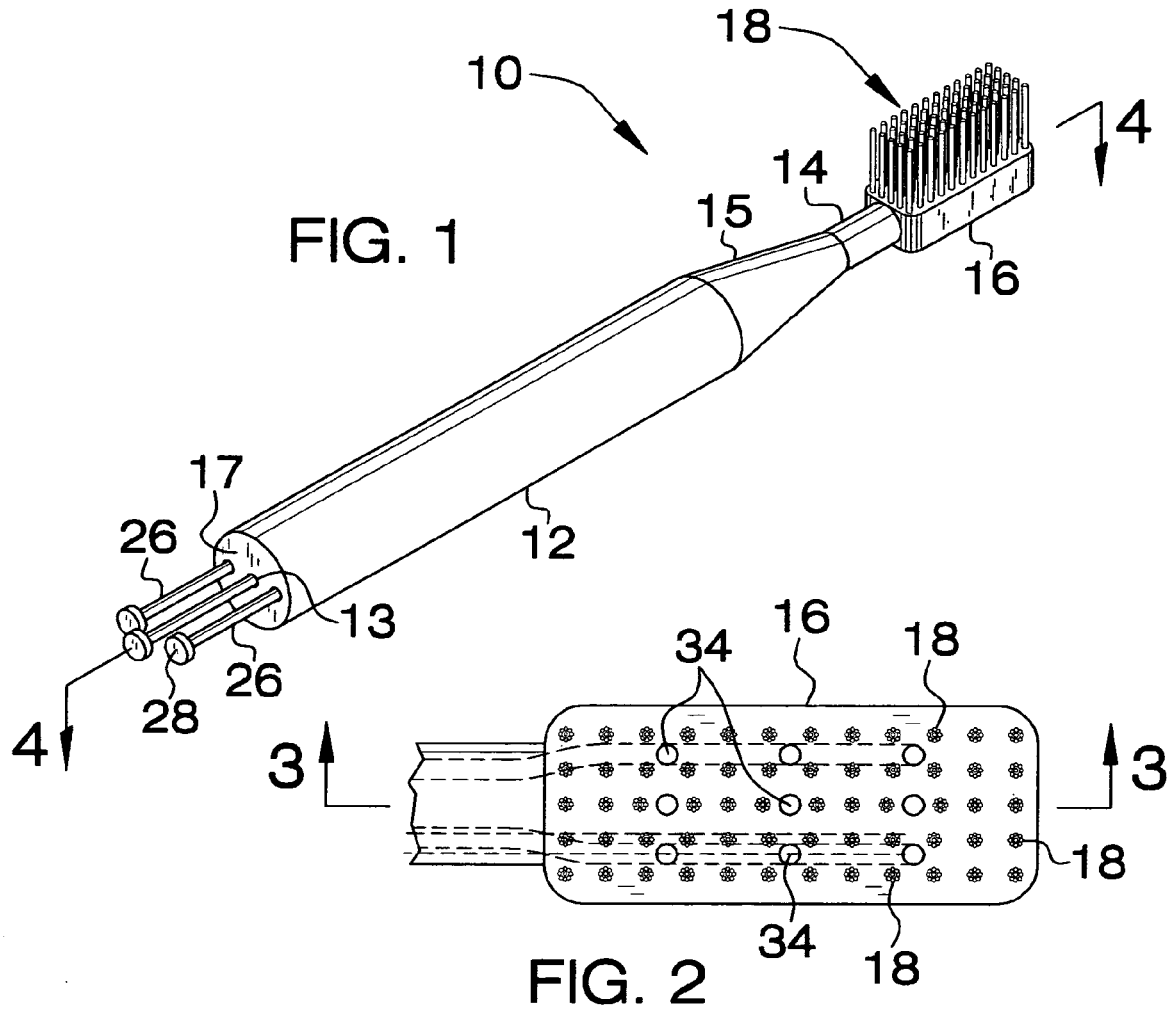
FIG. 1
FIG. 2
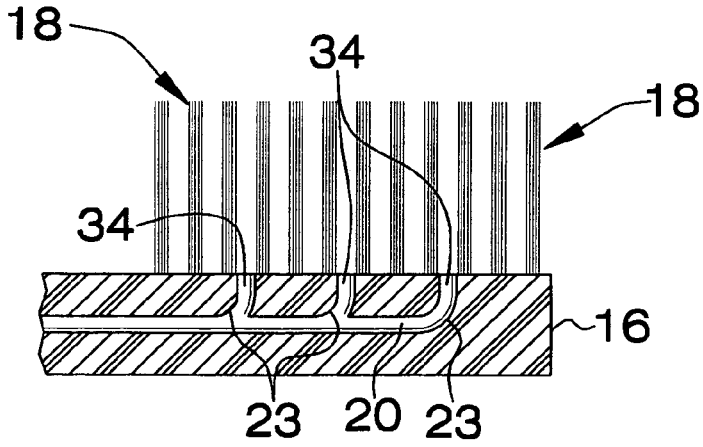
FIG. 3

DISPOSABLE TOOTHBRUSH

BACKGROUND OF THE INVENTION

The value of disposable toothbrushes is well known in the populace. A disposable toothbrush with a reservoir for dentifrice is of recognized value. Various toothbrushes provide dentifrice storage, and some combine mouthwash storage. None of the disposable toothbrushes known in prior art provide all of the needs for proper oral hygiene. None of the prior art disposable toothbrushes provide a basic disposable toothbrush which stores and properly dispenses toothpaste, water, and mouthwash, with hand controls for each, as does the present device.

FIELD OF THE INVENTION

The disposable toothbrush relates to toothbrushes and more especially to a disposable toothbrush which stores and properly dispenses toothpaste, water, and mouthwash.

DESCRIPTION OF THE PRIOR ART

Prior related art teaches various toothbrushes with dentifrice. Each has its own particular value, but none offer the particular advantages of the design and capabilities of the present disposable toothbrush, such as the ability to store and properly dispense toothpaste, water, and mouthwash, with hand controls for each dispensed item.

U.S. Pat. No. 5,769,553 issued to Chaudhri et al. on Jun. 23, 1998 teaches a toothbrush containing toothpaste. The toothbrush also stores mouthwash and dental floss. The toothbrush is not designed as an inexpensive disposable device.

U.S. Pat. No. 6,142,694 issued to Rivlin et al. issued on Nov. 7, 2000 teaches a disposable toothbrush with a dentifrice reservoir including a rotatable spindle for forcing the dentifrice from the storage compartment. The storage capabilities and dispensing mechanism differ distinctly from the present disposable toothbrush.

U.S. Pat. No. 5,425,590 issued to Duty et al. on Jun. 20, 1995 teaches a disposable toothbrush with toothpaste storage and manually activated pump for dispensing the toothpaste. The device does not store three needed oral hygiene agents and does not dispense the toothpaste with a mechanism similar to the present invention.

While the above-described devices fulfill their respective and particular objects and requirements, they do not describe a disposable toothbrush that provides for the advantages of the present disposable toothbrush. In this respect, the present disposable toothbrush substantially departs from the conventional concepts and designs of the prior art. Therefore, a need exists for an improved disposable toothbrush.

SUMMARY OF THE INVENTION

The general purpose of the disposable toothbrush, described subsequently in greater detail, is to provide a disposable toothbrush which has many novel features that result in an improved disposable toothbrush which is not anticipated, rendered obvious, suggested, or even implied by prior art, either alone or in combination thereof.

To attain this, the disposable toothbrush is comprised of a handle containing three storage compartments. The compartments store toothpaste, water, and mouthwash, respectively. The handle of the toothbrush melds smoothly into a taper which melds into a neck. The neck connects to the head with bristles. The taper and neck provide two functions. The taper and neck provide a reduced diameter from the handle for greater ease of use by a user, whereby a large handle need not be introduced into the mouth. The taper and neck further provide for a laminar flow of agents such that dispensing of the agents from the handle to the head is easily accomplished. The head contains a plurality of openings for each agent whereby an even distribution is attained. Preferably, each agent's conduit is provided with at least three openings within the head, at the base of the bristles. The conduit for each agent also comprises a bend prior to each opening whereby agent flow into the bristle area is eased.

The agents of the storage compartments of the handle are dispensed via pistons. Each piston is pushed as chosen by a plunger. Each plunger passes through a tube in the handle. Each plunger is user accessible through plunger passages in the cap. The cap further comprises an elastomeric seal for each plunger whereby the agents stored within the handle do not leak out. The cap enables the basic manufacturing step of agent insertion into the storage compartments, then sealing to capture the agents. Each plunger, outside the cap, is comprised of a knob. The knobs provide comfortable use of the plungers.

Thus has been broadly outlined the more important features of the improved disposable toothbrush so that the detailed description thereof that follows may be better understood and in order that the present contribution to the art may be better appreciated.

It is therefore an object of the disposable toothbrush to store three needed oral hygiene agents.

It is also an object of the disposable toothbrush to dispense the oral hygiene agents.

It is a further object of the disposable toothbrush to provide for inexpensive manufacturing.

It is an added object of the disposable toothbrush to provide for ease in filling the toothbrush during manufacturing.

And, it is an object of the disposable toothbrush to provide for readily sealing the oral hygiene agents within the toothbrush during manufacturing.

A further object of the disposable toothbrush is to provide laminar flow of the oral hygiene agents into the bristles.

Additionally, it is an object of the disposable toothbrush to provide a plurality of outlets within the bristles for the oral hygiene agents.

Yet another object of the disposable toothbrush is to provide for oral comfort in use.

These together with additional objects, features and advantages of the improved disposable toothbrush will be readily apparent to those of ordinary skill in the art upon reading the following detailed description of presently preferred, but nonetheless illustrative, embodiments of the improved disposable toothbrush when taken in conjunction with the accompanying drawings.

In this respect, before explaining the current embodiments of the improved disposable toothbrush in detail, it is to be understood that the disposable toothbrush is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved disposable toothbrush. It is therefore important that the claims be regarded as including such equivalent constructions insofar as they do not depart from the spirit and scope of the disposable toothbrush. It is also to be understood that the phraseology and terminology employed herein are for purposes of description and should not be regarded as limiting.

BRIEF DESCRIPTION OF THE DRAWINGS

FIG. 1 is a perspective view of the disposable toothbrush.

FIG. 2 is a top cross sectional view of the head.

FIG. 3 is a cross sectional view of FIG. 2, taken along the line 3-3.

DETAILED DESCRIPTION OF THE DRAWINGS

Figure 4:
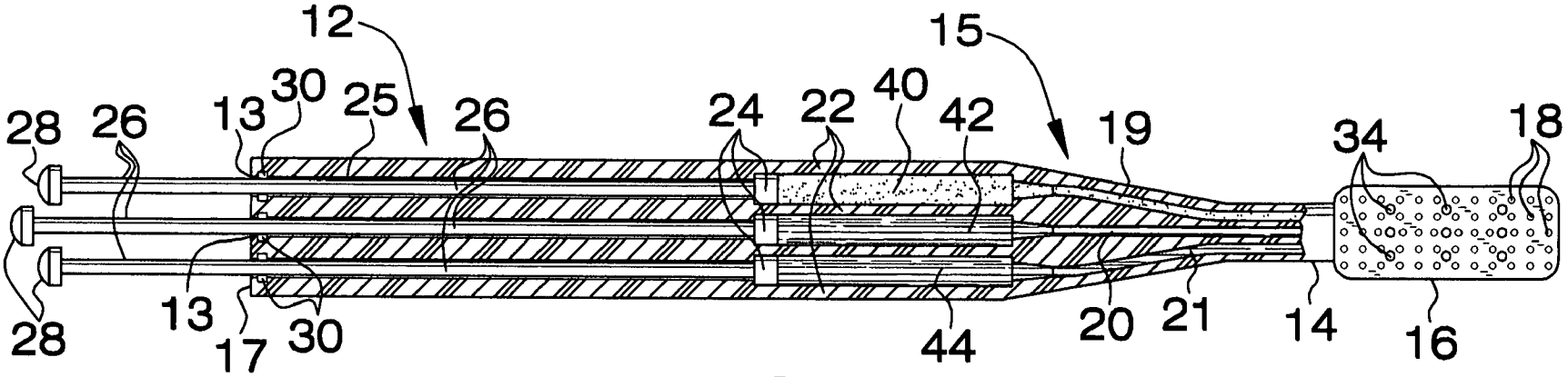
FIG. 4 is cross sectional view of FIG. 1, taken along the line 4-4.

With reference now to the drawings, and in particular FIGS. 1 through 5 thereof, the principles and concepts of the disposable toothbrush generally designated by the reference number 10 will be described.

Referring to FIG. 1, the toothbrush 10 is comprised of a handle 12. The handle 12 has a first end and a second end. The second end of the handle 12 is connected to a taper 15. The taper 15 tapers from the handle 12 to the neck 14. The neck 14 connects to the head 16. The taper 15 and neck 14 enable more comfortable insertion of the head 16 and bristles 18 into a user's mouth. The cap 17 is affixed to the first end of the handle 12. Plungers 26 pass through the cap 17. Each plunger 26 is ended with a knob 28.

Figure 5:
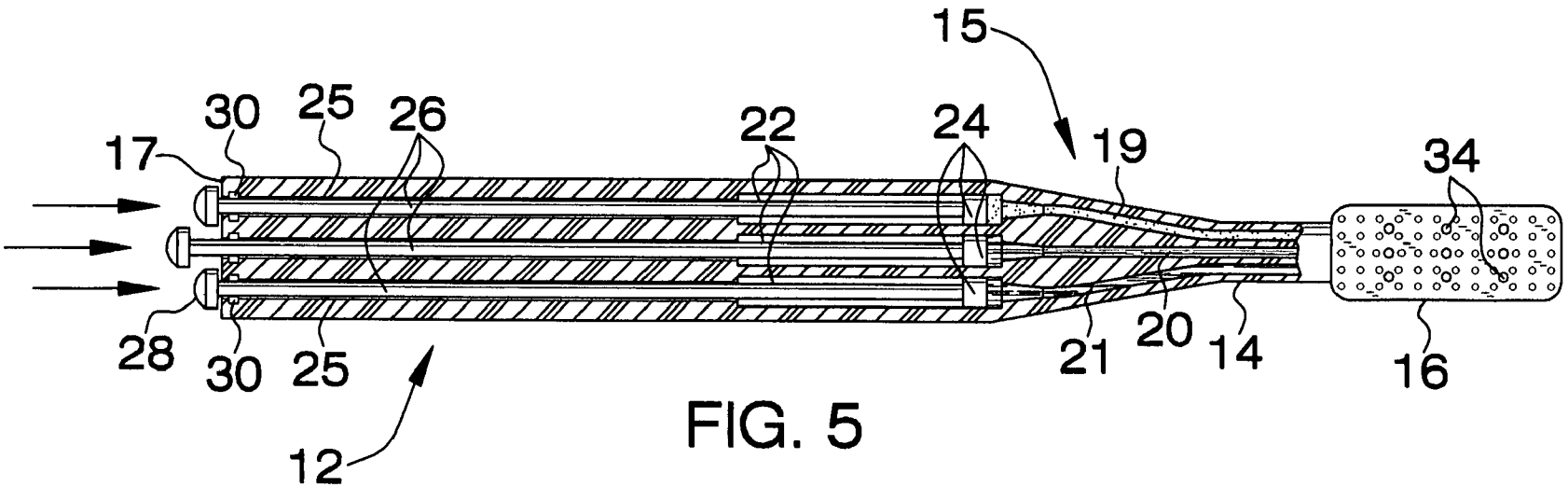
FIG. 5 is a view of FIG. 4, the plungers depressed to dispense oral hygiene agents.

Referring to FIGS. 4 and 5, three separate storage compartments 22 are disposed within the handle 12 and proximal to the second end of the handle 12. Each storage compartment 22 stores an agent of oral hygiene. The agents comprise a quantity of toothpaste 40 in one compartment 22. A quantity of water 42 is stored within one compartment 22. A quantity of mouthwash 44 is stored within one compartment 22. A piston 24 is movably disposed within each storage compartment 22. Three separate tubes 25 are disposed within and proximal to the first end of the handle 12. Each tube 25 is connected to one of the compartments 22. Three plungers 26 are provided. Each plunger 26 has a first end and a second end. The first end of each plunger 26 is connected to one of the pistons 24. Each plunger 26 passes through one of the tubes 25. A cap 17 is affixed to the first end of the handle 12. Three spaced apart passages 13 are disposed in the cap 17. Each passage 13 accommodates one of the plungers 26. An elastomeric seal 30 surrounds each plunger 26 passage 13 in the cap 17, whereby the agents within the storage compartments 22 do not leak. A knob 28 is disposed on the second end of each plunger 26. Each knob 28 is disposed on an outside of the handle 12 and cap 17. A head 16 is affixed to the second end of the handle 12. A plurality of bristles 18 is affixed to the head 16. A toothpaste conduit 19 connects the toothpaste storage compartment 22 to the head 16 area proximal to the bristles 18. A water conduit 20 connects the water storage compartment 22 to the head 16 area proximal to the bristles 18. A mouthwash conduit 21 connects the mouthwash storage compartment 22 to the area of the head 16 proximal to the bristles 18.

The taper 15 and the neck 14 provide for smooth contoured pathway for the conduits 19, 20, and 21, thereby further aiding in laminar flow of the agents from the handle 12 to the head 16. A potential need for excessive pressure from the pistons 24 to deliver agents is thereby negated.

Referring to FIGS. 2 and 3, the head 16 is comprised of three spaced apart openings 34 for each conduit 19, 20, and 21. The plurality of openings 34 insures even delivery of agents and also insures continued laminar flow of the agents. The toothpaste conduit 19, the water conduit 20 and the mouthwash conduit 21 each further comprise a bend 23 prior to each opening 34 to further insure ease of laminar flow of agents to the bristles 18 area.

With respect to the above description then, it is to be realized that the optimum dimensional relationships for the parts of the disposable toothbrush, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the disposable toothbrush.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the disposable toothbrush may be used.

Therefore, the foregoing is considered as illustrative only of the principles of the disposable toothbrush. Further, since numerous modifications and changes will readily occur to those skilled in the art, it is not desired to limit the disposable toothbrush to the exact construction and operation shown and described, and accordingly, all suitable modifications and equivalents may be resorted to, falling within the scope of the disposable toothbrush.

What is claimed is:

1. A disposable toothbrush with triple compartment handle, comprising:

an elongated handle, the handle having a first end and a second end;

three separate storage compartments within and proximal to the second end of the handle, each storage compartment storing an agent of oral hygiene, the agents comprising:

a quantity of toothpaste in one storage compartment;

a quantity of water in one compartment;

a quantity of mouthwash in one compartment;

a piston within each storage compartment;

a plunger connected to each piston;

a cap affixed to the first end of the handle;

three spaced apart passages in the cap, each passage accommodating one of the plungers;

an elastomeric seal surrounding each plunger passage in the cap;

a knob on each plunger, each knob disposed on an outside of the handle and cap;

a head affixed to the second end of the handle;

a plurality of bristles affixed to the head;

a conduit from the toothpaste compartment to an area of the head proximal to the bristles;

a conduit from the water compartment to an area of the head proximal to the bristles;

a conduit from the mouthwash compartment to an area of the head proximal to the bristles.

2. The toothbrush in claim 1 wherein the head is comprised of a plurality of at least three spaced apart openings for each conduit.

3. The toothbrush in claim 2 wherein each conduit in the head of the brush is further comprised of a bend prior to each opening.

4. The toothbrush in claim 2 wherein each conduit in the head of the brush is further comprised of a bend prior to each opening.

5. A disposable toothbrush with triple compartment handle, comprising:

an elongated handle, the handle having a first end and a second end;

three separate storage compartments within and proximal to the second end of the handle, each storage compartment storing an agent of oral hygiene, the agents comprising:

a quantity of toothpaste in one compartment;

a quantity of water within one compartment;

a quantity of mouthwash within one compartment;

a piston within each storage compartment;

three separate tubes within and proximal to the first end of the handle, each tube connected to one of the compartments;

three plungers, each plunger having a first end and a second end, the first end of each plunger connected to one of the pistons, each plunger passing through one of the tubes;

a cap affixed to the first end of the handle;

three spaced apart passages in the cap, each passage accommodating one of the plungers;

an elastomeric seal surrounding each plunger passage in the cap;

a knob on the second end of each plunger, each knob disposed on an outside of the handle and cap;

a head affixed to the second end of the handle;

a plurality of bristles affixed to the head;

a conduit from the toothpaste storage compartment to an area of the head proximal to the bristles;

a conduit from the water compartment to an area of the head proximal to the bristles;

a conduit from the mouthwash compartment to an area of the head proximal to the bristles.

6. The toothbrush in claim 5 wherein the head is comprised of a plurality of at least three spaced apart openings for each conduit.

7. The toothbrush in claim 6 wherein each conduit in the head of the brush is further comprised of a bend prior to each opening.

8. The toothbrush in claim 7 wherein the head is connected to the handle via a taper and a neck.

9. The toothbrush in claim 6 wherein each conduit in the head of the brush is further comprised of a bend prior to each opening.

10. The toothbrush in claim 9 wherein the head is connected to the handle via a taper and a neck.

11. The toothbrush in claim 6 wherein the head is connected to the handle via a taper and a neck.

* * * * *